US007558523B2

(12) United States Patent
Wang et al.

(10) Patent No.: US 7,558,523 B2
(45) Date of Patent: Jul. 7, 2009

(54) AUTOMATIC DOCUMENT FEEDER FOR DUPLEX SCANNING

(75) Inventors: Chung-Kai Wang, Taipei (TW); Chien-Kuo Kuan, Taipei (TW)

(73) Assignee: Primax Electronics Ltd., Taipei (TW)

( * ) Notice: Subject to any disclaimer, the term of this patent is extended or adjusted under 35 U.S.C. 154(b) by 328 days.

(21) Appl. No.: 11/532,279

(22) Filed: Sep. 15, 2006

(65) Prior Publication Data

US 2007/0280762 A1 Dec. 6, 2007

(30) Foreign Application Priority Data

Jun. 2, 2006 (TW) ..... 95119544 A

(51) Int. Cl.
*G03G 15/00* (2006.01)

(52) U.S. Cl. ..... 399/367; 399/364; 399/373; 399/374; 399/377; 399/405; 271/131; 271/279; 271/301

(58) Field of Classification Search ..... 399/374, 399/364, 373, 377, 405; 271/131, 279, 301
See application file for complete search history.

(56) References Cited

U.S. PATENT DOCUMENTS 6,151,478 A * 11/2000 Katsuta et al. ..... 399/372
2005/0285322 A1* 12/2005 Sheng et al. ..... 271/3.14
2006/0076727 A1* 4/2006 Yang ..... 271/3.14

* cited by examiner

*Primary Examiner*—Judy Nguyen
*Assistant Examiner*—Andy L Pham
(74) *Attorney, Agent, or Firm*—Kirton & McConkie; Evan R. Witt

(57) ABSTRACT

An automatic document feeder for duplex scanning includes a scanning module, a pickup roller assembly, a first discharging roller assembly, a second discharging roller assembly, a first path, a second path, a third path, a sheet feeding tray, a first discharging tray and a second discharging tray. The first discharging tray is used as a reverse region. Since only the scanning module inside the automatic document feeder is used for scanning the document without the participation of the flatbed image scanning portion, the operative space for accommodating the scanning module in the flatbed image scanning portion is not required. As a result, the length and the overall volume thereof are reduced.

3 Claims, 2 Drawing Sheets

AUTOMATIC DOCUMENT FEEDER FOR DUPLEX SCANNING

FIELD OF THE INVENTION

The present invention relates to an automatic document feeder, and more particularly to an automatic document feeder for duplex scanning.

BACKGROUND OF THE INVENTION

A duplex scanning device is widely used for scanning images on both sides of a document. A typical duplex scanning device comprises a flatbed image scanning portion and an automatic document feeder arranged above the flatbed image scanning portion. Generally, there are two mechanisms for performing the duplex scanning processes. The first mechanism uses a scanning module in the flatbed image scanning portion for scanning one side of the document while using another scanning module in the automatic document feeder for scanning the other side of the document. The second mechanism uses only one scanning module in the flatbed image scanning portion to scan both sides of the document.

Since the first mechanism has two scanning modules, the scanning speed for performing a duplex scanning operation is relatively larger than the second mechanism. However, the cost of the first mechanism is higher than that of the second mechanism. Consequently, the second mechanism is prevailing. When the second mechanism with the single scanning module performs a duplex scanning operation, the document needs to pass through the scan region for three times. As a consequence, the duplex scanning operation by the second mechanism is also referred as a three-pass scanning operation. When the document is transported across the scan region for the first time, the scanning module scans a front side of the document. When the document is transported across the scan region for the second time, the scanning module scans a back side of the document. Finally, the document is transported across the scan region for the third time to rearrange each document into the same order as that of the original stack.

Referring to FIG. 1, a schematic cross-sectional view of a conventional duplex scanning device 100 operated by the second mechanism with the single scanning module is illustrated. First of all, a document 111 to be scanned is placed in a sheet feeding tray 102. The automatic document feeder 101 transports the document 111 into a first path 104. Next, the document 111 enters a scan region 107 through a second path 106. When the document is transported across the scan region 107, a scanning module 105 scans a front side of the document 111. Then, the document 111 is transported across a third path 108 and a guiding rod 109 to a reverse region 112. The guiding rod 109 is switched between a first position leading the document 111 to the reverse region 112 and a second position leading the document 111 to the discharging tray 103. In the reverse region 112, the document 111 is transported across the guiding rod 109 to a fourth path 110, and then enters the scan region 107 through the second path 106. When the document 111 is transported across the scan region 107, the scanning module 105 scans a back side of the document 111. Then, the document 111 is transported across the third path 108 and the guiding rod 109 to the reverse region 112. Next, the document 111 in the reverse region 112 is transported across the guiding rod 109 to the fourth path 110, the second path 106, the scan region 107 and third path 108. When the document passes through the scan region 107 for the third time, the scanning module 105 does not scan the document 111. Finally, the guiding rod 109 is switched to the second position, thereby leading the document 111 to the discharging tray 103.

As previously described, the duplex scanning device with the single scanning module includes one flatbed image scanning portion and one automatic document feeder. The scanning module in the flatbed image scanning portion is responsible for performing the duplex scanning operation. In other words, for performing the duplex scanning operation, the automatic document feeder fails to be operated alone but should be cooperated with the flatbed image scanning portion.

Please refer to FIG. 1 again. During the process of performing the duplex scanning operation, the scanning module 105 should be moved under the scanning window (i.e. the scan region) 107 such that the light emitted from the scanning module 105 can be projected onto the document 111 passing over the scanning window 107. Therefore, it is required to reserve an additional operative space 120 for accommodating the scanning module 105. Due to the operative space 120, the length and the overall volume of the duplex scanning device 100 are increased.

In views of the above-described disadvantages resulted from the prior art, the applicant keeps on carving unflaggingly to develop an improved automatic document feeder for duplex scanning according to the present invention through wholehearted experience and research.

SUMMARY OF THE INVENTION

It is an object of the present invention to provide an automatic document feeder for duplex scanning, in which the operative space for accommodating the scanning module is reduced and the automatic document feeder can be operated without the flatbed image scanning portion.

In accordance with an aspect of the present invention, there is provided an automatic document feeder for duplex scanning. The automatic document feeder comprises a scanning module, a sheet feeding tray, a first discharging tray, a second discharging tray, a first path, a second path, a third path, a pickup roller, a first discharging roller assembly and a second discharging roller assembly. The scanning module is used for scanning a document in a scan region. The sheet feeding tray is disposed at a first side of the scanning module for placing therein the document to be scanned. The first discharging tray is disposed above the sheet feeding tray for supporting the document. The second discharging tray is disposed at a second side of the scanning module for placing therein the document to be scanned. The first path is arranged between the sheet feeding tray and the scan region. The second path is arranged between the scan region and the first discharging tray. The third path is arranged between the first discharging tray and the second discharging tray and passes through the scan region. The pickup roller assembly is used for transporting the document into the first path. The first discharging roller assembly is used for transporting the document into the third path or the first discharging tray. The second discharging roller assembly is used for transporting the document into the second path or the second discharging tray.

In an embodiment, the first discharging roller assembly comprises a first drive roller and a first driven roller. The first drive roller is used for transporting the document into the first discharging tray or the third path by changing the rotational direction thereof.

In an embodiment, the second discharging roller assembly comprises a second drive roller and a second driven roller. The second drive roller is used for transporting the document into the second discharging tray or the second path by changing the rotational direction thereof.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
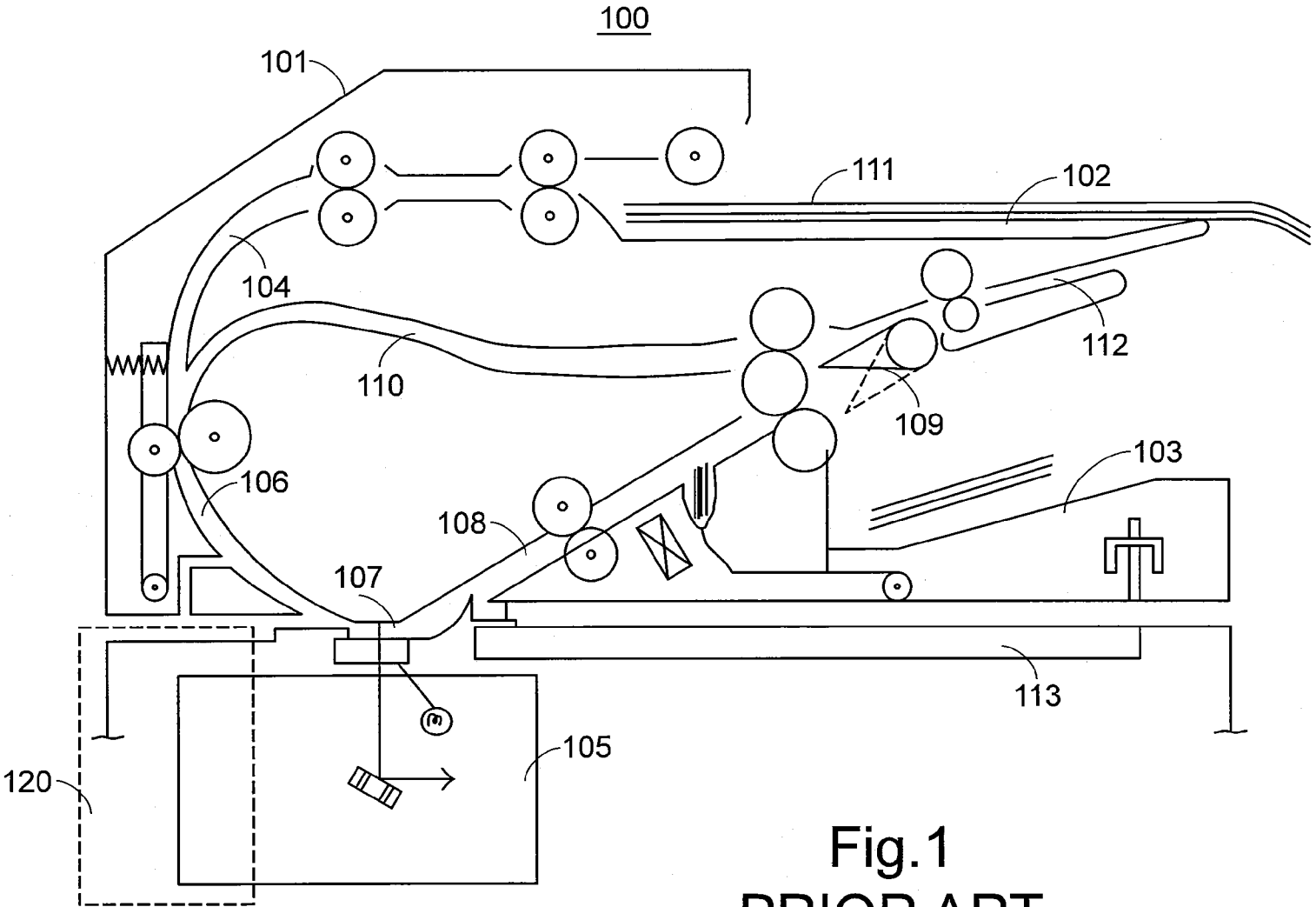
Fig. 1 PRIOR ART
FIG. 1 is a schematic cross-sectional view of a conventional duplex scanning device with a single scanning module.
Figure 2:
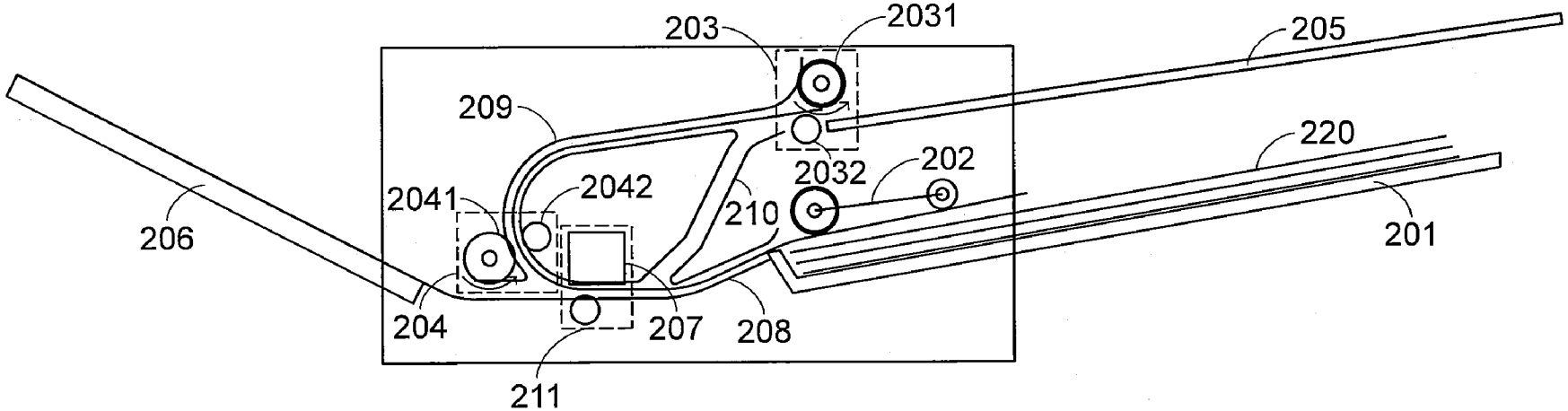
FIG. 2 is a schematic cross-sectional view of an automatic document feeder for duplex scanning according to a preferred embodiment of the present invention.

Referring to FIG. 2, a schematic cross-sectional view of an automatic document feeder for duplex scanning according to a preferred embodiment of the present invention is illustrated. The automatic document feeder 200 as shown in FIG. 2 comprises a sheet feeding tray 201, a pickup roller assembly 202, a first discharging roller assembly 203, a second discharging roller assembly 204, a first discharging tray 205, a second discharging tray 206, a scanning module 207, a first path 208, a second path 209 and a third path 210. The first discharging roller assembly 203 comprises a first driven roller 2031 and a first drive roller 2032. The second discharging roller assembly 204 comprises a second driven roller 2041 and a second drive roller 2042.

Please refer to FIG. 2 again. Hereinafter, the procedure of performing a single-side scanning operation by the automatic document feeder 200 is illustrated. First of all, the documents 220 to be scanned are placed in the sheet feeding tray 201. The pickup roller assembly 202 transports a first document 220 into a scan region 211 through the first path 208. When the document 220 is transported across the scan region 211, the scanning module 207 scans the document 220. Next, the second drive roller 2042 of the second discharging roller assembly 204 is rotated clockwise to drive anti-clockwise rotation of the second driven roller 2041, so that the second discharging roller assembly 204 transports the document 220 across the second path 209 to the first discharging roller assembly 203. Next, the first drive roller 2032 of the first discharging roller assembly 203 is rotated clockwise to drive anti-clockwise rotation of the first driven roller 2031, so that the document 220 is discharged to the first discharging tray 205. Meanwhile, the first document has implemented the single-side scanning operation. The remainder documents 220 in the sheet feeding tray 201 successively implement the single-side scanning operations identical to that for the first document 220. As a consequence, the documents 220 are stacked in the first discharging tray 205 in the same order as that of the original stack.

Please refer to FIG. 2 again. Hereinafter, the procedure of performing a duplex scanning operation by the automatic document feeder 200 is illustrated. First of all, the documents 220 to be scanned are placed in the sheet feeding tray 201. The pickup roller assembly 202 transports a first document 220 into a scan region 211 through the first path 208. When the document 220 is transported across the scan region 211, the scanning module 207 scans the first side of the document 220. Next, the second drive roller 2042 of the second discharging roller assembly 204 is rotated clockwise to drive anti-clockwise rotation of the second driven roller 2041, so that the second discharging roller assembly 204 transports the document 220 across the second path 209 to the first discharging roller assembly 203. Next, the first drive roller 2032 of the first discharging roller assembly 203 is rotated clockwise to drive anti-clockwise rotation of the first driven roller 2031, so that the document 220 is discharged to the first discharging tray 205. Meanwhile, the majority of the document 220 enters the first discharging tray 205, but the rear end of the document 220 is nipped between first driven roller 2031 and the first drive roller 2032 of the first discharging roller assembly 203. Next, the first driven roller 2031 of the first discharging roller assembly 203 is rotated clockwise, so that the document 220 in the first discharging tray 205 is transported to the scan region 211 through the third path 210. When the document 220 is transported across the scan region 211, the scanning module 207 scans the second side of the document 220. Next, the second driven roller 2041 of the second discharging roller assembly 204 is rotated clockwise, so that the document 220 is discharged to the second discharging tray 206. Meanwhile, the first document has implemented the duplex scanning operation. The remainder documents 220 in the sheet feeding tray 201 successively implement the duplex scanning operations identical to that for the first document 220. As a consequence, the documents 220 are stacked in the second discharging tray 206 in the same order as that of the original stack.

From the above description, when the automatic document feeder of the present invention performs the duplex scanning operation, the document needs to pass through the scan region for two times. That is, the duplex scanning operation by the present invention can be referred as a two-pass scanning operation. In comparison with the conventional three-pass scanning operation, the number of transporting the document through the scan region is reduced. Consequently, the time period of performing the duplex scanning operation is shortened.

It is noted that, however, those skilled in the art will readily observe that numerous modifications and alterations of the automatic document feeder may be made while retaining the teachings of the invention. For example, the motor for driving the rollers and the circuit board for control operations of the automatic document feeder can be integrated into the automatic document feeder. As a result, the duplex scanning operation can be done by using only the automatic document feeder without the cooperation of a flatbed image scanning portion. Alternatively, the automatic document feeder of the present invention can be mounted on a flatbed image scanning portion. In this circumstance, since the duplex scanning operation is performed by the scanning module included in the automatic document feeder, the scanning module included in the flatbed image scanning portion does not participate in the duplex scanning operation. As a consequence, the operative space 120 for accommodating the scanning module in the flatbed image scanning portion is not required, and thus the length and the overall volume thereof are reduced. Moreover, the first discharging tray 205 and the second discharging tray 206 can be made collapsed or expanded in order to save more space. Alternatively, the automatic document feeder of the present invention can be combined with a printer to form as a multifunction peripheral capable of performing the duplex scanning operation.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An automatic document feeder for single-side and duplex scanning, said automatic document feeder comprising:

a scanning module for scanning one or more documents face up in a scan region;

a sheet feeding tray disposed at a first side of said scanning module for placing therein said one or more documents to be scanned face up in an original document order;

a first discharging tray disposed above said sheet feeding tray for supporting said one or more documents scanned according to single-side scanning;

a second discharging tray disposed at a second side of said scanning module for supporting therein said one or more documents scanned according to duplex scanning;

a first path arranged between said sheet feeding tray and said scan region;

a second path arranged between said scan region and said first discharging tray;

a third path arranged between said first discharging tray and said second discharging tray and passing through said scan region;

a pickup roller assembly for transporting said one or more documents into said first path;

a first discharging roller assembly for transporting said one or more documents into said third path or said first discharging tray; and a second discharging roller assembly for transporting said one or more documents into said second path or said second discharging tray.

2. The automatic document feeder according to claim 1 wherein said first discharging roller assembly comprises:

a first drive roller for transporting said one or more documents into said first discharging tray or said third path by changing the rotational direction thereof; and a first driven roller.

3. The automatic document feeder according to claim 1 wherein said second discharging roller assembly comprises:

a second drive roller for transporting said one or more documents into said second discharging tray or said second path by changing the rotational direction thereof; and a second driven roller.

* * * * *